US007984894B1

(12) United States Patent
Chauza

(10) Patent No.: US 7,984,894 B1
(45) Date of Patent: Jul. 26, 2011

(54) ELECTRICAL CLUTCH ENGAGEMENT/DISENGAGEMENT APPARATUS

(76) Inventor: Roger N. Chauza, Coppell, TX (US)

( * ) Notice: Subject to any disclaimer, the term of this patent is extended or adjusted under 35 U.S.C. 154(b) by 212 days.

(21) Appl. No.: 12/214,879

(22) Filed: Jun. 23, 2008

Related U.S. Application Data

(60) Provisional application No. 60/936,888, filed on Jun. 22, 2007.

(51) Int. Cl.
*B66D 1/22* (2006.01)

(52) U.S. Cl. ..... 254/344; 254/361

(58) Field of Classification Search ..... 254/344, 254/323, 361
See application file for complete search history.

(56) References Cited

U.S. PATENT DOCUMENTS

| | | | | |
|---|---|---|---|---|
| 2,406,156 | A | 8/1946 | Nardone | |
| 2,552,859 | A | 5/1951 | Nardone | |
| 3,744,760 | A * | 7/1973 | Uher | 254/351 |
| 3,938,595 | A * | 2/1976 | Swenson | 173/1 |
| 3,986,588 | A | 10/1976 | Kuzarov | |
| 4,084,793 | A | 4/1978 | Gardiner | |
| 4,187,936 | A | 2/1980 | Davenport | |
| 4,192,409 | A | 3/1980 | Ueda | |
| 4,379,502 | A | 4/1983 | Ball et al. | |
| 4,390,161 | A * | 6/1983 | Nelson | 254/356 |
| 4,396,102 | A | 8/1983 | Beach | |
| 4,426,064 | A * | 1/1984 | Healy | 254/342 |
| 4,448,395 | A | 5/1984 | Purdy | |
| 4,928,925 | A * | 5/1990 | Christison | 254/272 |
| 5,249,777 | A * | 10/1993 | Herving | 254/289 |
| 5,522,582 | A * | 6/1996 | Dilks | 254/323 |
| 5,599,003 | A * | 2/1997 | Seemann et al. | 251/30.03 |
| 5,692,735 | A * | 12/1997 | Aho et al. | 254/323 |
| 5,842,684 | A | 12/1998 | Aho | |
| 6,484,598 | B2 * | 11/2002 | Peter | 74/335 |
| 6,995,682 | B1 | 2/2006 | Chen et al. | |
| 2002/0007691 | A1 * | 1/2002 | Peter | 74/473.12 |
| 2005/0247812 | A1 * | 11/2005 | Holbein et al. | 242/374 |
| 2008/0078980 | A1 * | 4/2008 | Aho et al. | 254/344 |
| 2009/0107192 | A1 * | 4/2009 | Arriola Arrizabalaga et al. | 70/224 |
| 2010/0099533 | A1 * | 4/2010 | Horsfall et al. | 475/146 |

* cited by examiner

*Primary Examiner* — Emmanuel M Marcelo
(74) *Attorney, Agent, or Firm* — Roger N. Chauza, P.C.

(57) ABSTRACT

A clutch operable with equipment, including a winch of the type having a planetary gear reduction assembly for driving a cable drum. The planetary gear assembly includes a ring gear which, when allowed to rotate, effectively disconnects the drive motor from the cable drum. When the ring gear is fixed against rotation, the drive motor can drive the cable drum to wind or unwind the cable therefrom. A bistable solenoid is employed so that a plunger thereof is engageable with the ring gear to either allow rotation or prevent rotation, and thus engage or disengage the clutch. The bistable solenoid does not require electrical power when the plunger is in either stable position, thereby conserving electrical energy.

18 Claims, 2 Drawing Sheets

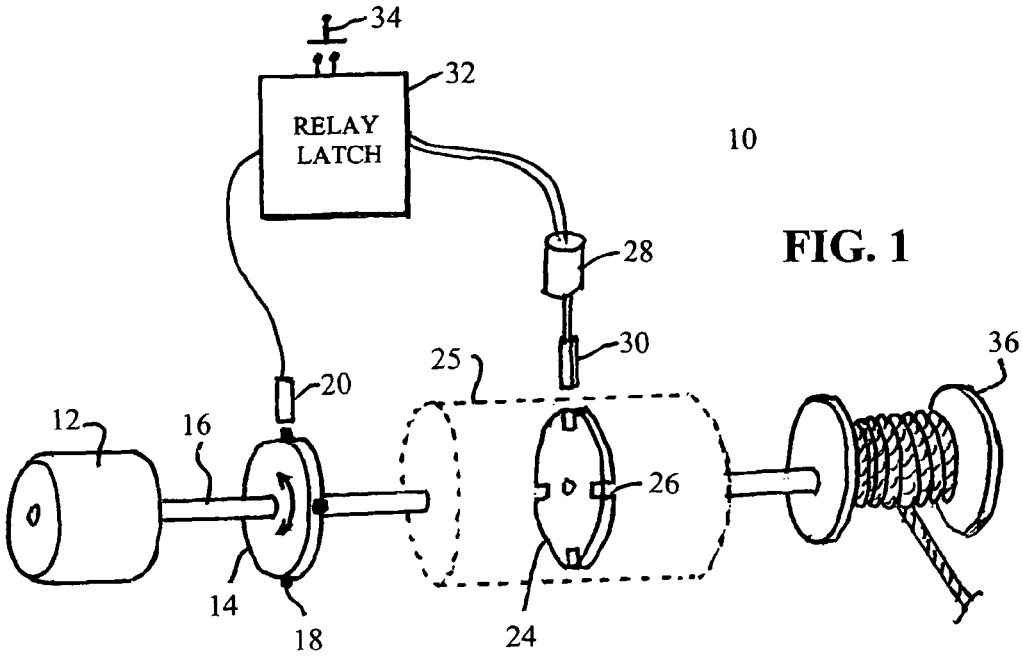
FIG. 1
FIG. 2
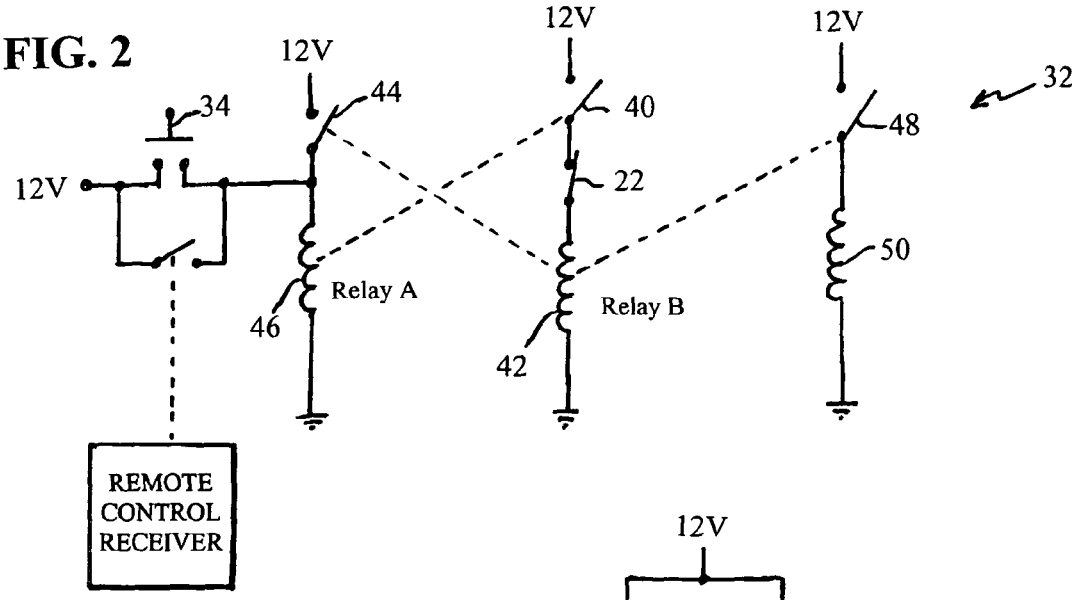
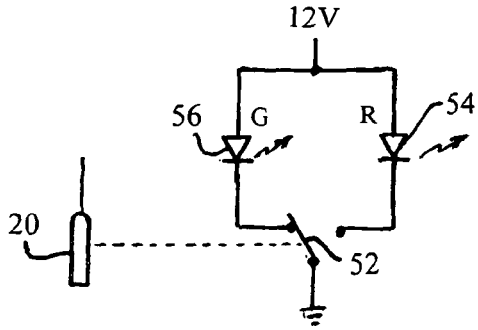
FIG. 3

ELECTRICAL CLUTCH ENGAGEMENT/DISENGAGEMENT APPARATUS

RELATED APPLICATIONS

This non-provisional patent application claims the benefit of U.S. provisional patent application No. 60/936,888, filed Jun. 22, 2007 entitled "Clutch Engagement/Disengagement Apparatus."

TECHNICAL FIELD OF THE INVENTION

The present invention relates in general to clutches for engaging and disengaging drive mechanisms, and more particularly to clutch apparatus that is electrically operated for disengaging a clutch.

BACKGROUND OF THE INVENTION

Clutches are employed to assist in the engagement and disengagement of drive trains and other power driven equipment. The benefit of the use of a clutch can be that the power train can be disconnected without stopping the power source, such as an engine, motor or the like. In other situations, a clutch can be used to disconnect the power source from the load so that the load can be moved without affecting the power source.

Winches and hoists include examples of the use of clutches to connect and disconnect the load from the power source. Vehicle winches are generally driven by a reversible DC motor to rotate a cable drum one direction or an opposite direction to wind and unwind the cable from the drum. When it is desired to play out the cable from the drum, for example, to pull the cable therefrom to connect the end of the cable to an object, the clutch is engaged to allow the drum to spool freely and allow the cable to be pulled therefrom without also turning the DC motor. Once the cable is played out a desired length and connected to the load, the clutch is disengaged to thereby allow the DC motor to turn the drum and wind the cable thereon and pull the load toward the winch. There are many types of winch clutches that are manually operable to engage and disengage the cable drum from the driving motor. Examples of manual and other types of clutches are described in U.S. Pat. Nos. 4,396,102; 4,379,502; 4,192,409; 4,187,936; 4,084,793; and 3,986,588.

While the mechanical or manual clutches function well to engage and disengage loads from the power source, such devices require the operator to be present and in the immediate vicinity of the winch. There are instances where it is desirable that the operator to be at a location remote from the winch, but yet able to control the winch. U.S. Pat. No. 5,522,582 discloses a remote controlled winch that is equipped with a long electrical umbilical cord with a control so that the operator can control the winch without having to manually operate push switches located on the winch itself. U.S. Pat. No. 6,995,682 discloses a wireless remote control for a winch, where a hand-held unit electrically controls the on-off status and the forward/reverse mode of operation of the winch in a wireless manner.

It is a common practice to incorporate a clutch in a winch of the type employing planetary gear reduction apparatus. It is well known that the use of planetary gear reduction apparatus involves a ring gear and sun gears to achieve the gear reduction function. The planetary gear reduction apparatus can include one or more stages to achieve the degree of reduction in the rpm of the cable drum 36 with respect to the driving source. In many winches, including the types without clutches incorporated in the planetary gear assembly, the ring gear of the planetary gear reduction assembly is attached to the case or housing of the winch to prevent rotational movement. In winches of the types incorporating clutches with the planetary gear assemblies, the ring gear is maintained stationary when the clutch is disengaged so that normal gear reduction functions can be carried out. However, when it is desired to engage the clutch and disconnect the power source from the cable drum, the ring gear is allowed to rotate with the sun gears and other associated gears, thereby effectively disconnecting the power source from the cable drum.

The clutch/planetary gear assembly is generally operated using a rotatable ring gear with a notch in the periphery thereof, and a pin that can be moved in and out of the notch to allow rotation or prevent rotation of the ring gear. The pin can be moved either manually using a lever, or electrically using a solenoid where the plunger functions as the pin. Such a winch clutch is described in U.S. Pat. No. 5,842,684. The solenoid is of the type that must be continuously operated during clutch engagement. When the winch is battery powered, as are many vehicle winches, the continuous use of current from the battery of the vehicle can be a concern.

From the foregoing, it can be seen that a need exists for a clutch that can be remote controlled using wireless means, and that does not require electrical energy during periods of engagement. Another need exists for a winch control where, once the clutch is engaged, it can be automatically disengaged when the power source is operated to control the winding or unwinding of the cable with respect to the drum.

SUMMARY OF THE INVENTION

In accordance with the principles and concepts of the invention, there is disclosed a clutch used with a machine, where the clutch can be engaged on activation of a control, and automatically disengaged on commencement of operation of the machine.

According to a feature of the invention, the clutch employs a pulsed bistable solenoid for engaging and disengaging the clutch, whereby electrical energy is conserved.

In accordance with one embodiment of the invention, disclosed is a clutch operable with a rotary member to provide engagement and disengagement of a drive train. The clutch includes a power source for delivering rotary power, and a load driven by the rotary power of the power source. A rotating member is adapted for allowing the load to be driven when the rotary member is stationary, and for allowing delivery of the rotary power from the power source to the load when the rotary member is allowed to rotate. An electrical bistable solenoid has a movable plunger, where the plunger is adapted for engaging with the rotating member to control rotary motion of the rotating member. The bistable solenoid has two states in which the plunger is retracted and extended, and the two states can be sustained without providing electrical energy to the bistable solenoid. The bistable solenoid only requires electrical energy to change from one state to another state, whereby electrical energy is reduced when the bistable solenoid is in either bistable state.

In accordance with another embodiment of the invention, disclosed is a clutch operable with a planetary gear reduction assembly to provide engagement and disengagement between a motor and a cable drum. The clutch includes a bistable solenoid having a plunger movable between two stable positions, where the bistable solenoid is of the type that needs no electrical energy to maintain the two stable positions. The planetary gear reduction assembly includes a ring gear, and the bistable solenoid plunger is adapted for engaging the ring gear to allow rotation to disengage the clutch, and to prevent rotation of the ring gear to disengage the clutch. A winch control has a clutch engage switch which, when activated, drives the bistable solenoid with electrical energy to cause the plunger to be retracted to a first stable state out of engagement with the ring gear to thereby engage the clutch. The winch control has a clutch disengage switch which, when activated, drives the bistable solenoid with electrical energy to cause the plunger to be extended to a second stable state and into engagement with the ring gear to thereby disengage the clutch.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which:

FIG. 1 is a diagram illustrating a clutch incorporated into a planetary gear assembly of a winch;

FIG. 2 is an electrical schematic drawing of a circuit for allowing the clutch to be engaged by operating an electrical switch, and automatically disengaged when the winch motor is operated;

FIG. 3 is a diagram of a circuit that detects when the winch is in a condition for clutch operation.

DETAILED DESCRIPTION OF THE INVENTION

Figure 4:
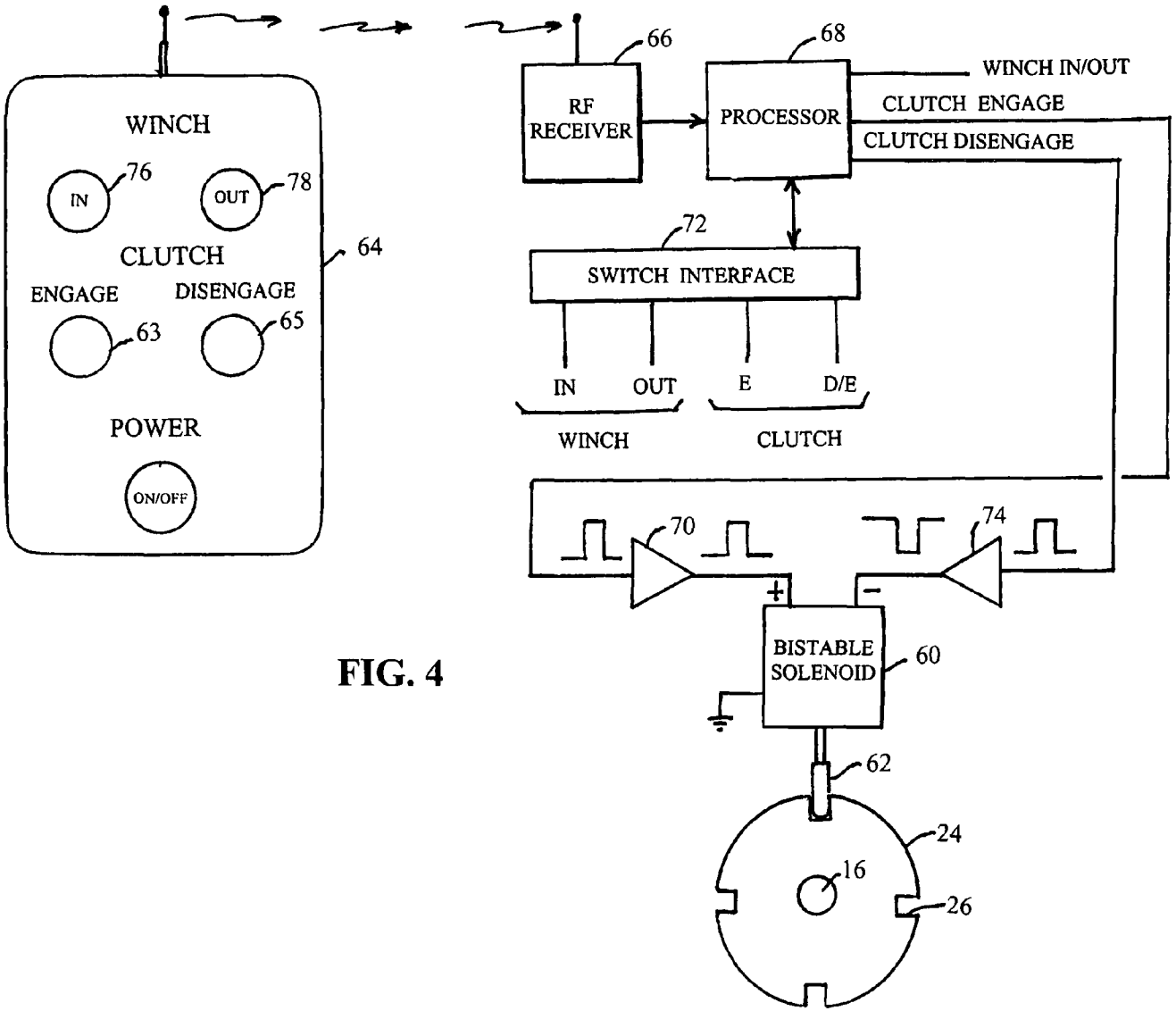
FIG. 4 is a diagram of a wireless remote control for a winch employing a bistable type of solenoid so that electrical power is not required during engagement of the clutch.

The FIGS. 1 and 2 illustrate the clutch engagement and disengagement apparatus 10 according to one embodiment of the invention. The clutch apparatus 10 is designed to manually engage the clutch by pushing an electrical button or switch on the winch, on a control attached to an umbilical cord, or by pushing a wireless remote control button to engage the winch clutch, and automatically disengage the clutch when the winch motor 12 rotates. While the motor 12 illustrated in the preferred embodiment can be a reversible DC motor 12, an AC motor or a hydraulic motor can function with equal effectiveness.

With reference to FIG. 1, the relevant components of the winch clutch 10 are shown. The winch motor is preferably a reversible DC motor 12 connected to some mechanism 14 that rotates with the motor shaft 16, such as the motor shaft itself, a winch disk, winch brake parts or planetary gear parts thereof. In the preferred embodiment, a disk 14 is mounted to the motor shaft 16 and rotates therewith. Mounted to the rotating disk 14, or other rotating component of the winch, are one or more magnets 18. Fixed proximate to the rotational path of the magnet 18 is a magnetic switch 20 which has normally closed contacts 22, shown in FIG. 2. When the magnetic switch 20 is not physically close to the magnet 18, the contacts 22 of the magnetic switch 20 are closed. But, when the motor 12 rotates the disk 14 so that the magnet 18 is brought in the proximity of the magnetic switch 20, the contacts 22 of the magnetic switch 20 open.

The output ring gear 24 of the planetary gear assembly 25, shown in phantom, has one or more notches 26 formed in peripheral edge thereof. Mounted to the case of the winch is a solenoid 28 with a plunger that moves up and down. When the solenoid 28 is not energized, the block 30 fixed to the end of the solenoid plunger drops down into the notch 26 of the ring gear 24 and prevents rotational movement of the ring gear 24. When the solenoid 28 is energized, the plunger is drawn upwardly, thereby retracting the block 30 from the notch 26 in the ring gear 24, whereupon the ring gear 24 is then free to rotate. This effectively disconnects the DC motor 12 from the cable drum 36 and allows the cable to be played out.

Shown in FIG. 1 is a relay latch 32 for operating the solenoid 28 during clutch engagement, and for releasing the solenoid 28 when the magnetic switch 20 senses the proximity of a magnet 18. The operation is as follows. During the normal state of the winch, namely when the clutch apparatus 10 is disengaged and the motor 12 drives the cable drum 36, the solenoid 28 is not energized and the plunger block 30 is in its downward position so that the output ring gear 24 is locked against rotation. When the user desires to engage the clutch apparatus 10, he/she pushes the electrical push button switch 34 on the winch, or via remote control, whereupon the solenoid 28 is energized and the plunger block 30 is lifted out of engagement with the notch 26 formed in the output ring gear 24. This condition remains even when the push button 34 is released. However, when the winch motor 12 is activated, the disk 14 rotates and the magnet 18 passes by the magnetic switch 20, whereupon the contacts 22 of the magnetic switch 20 open and cause the relay latch 32 to release and thus de-energize the solenoid 28. The plunger block 30 of the solenoid 28 then drops down into the notch 26 in the output ring gear 24 and the winch can be operated in the normal manner since the clutch is disengaged. The plunger of the solenoid 28 can be of the type that is spring loaded to push the plunger and block 30 attached thereto out of the solenoid housing when not electrically energized.

FIG. 2 is the electrical diagram of the electrical circuit for controlling the engagement and the disengagement of the clutch. The relay latching circuit 32 is of conventional design, and could be made of other electrical components and circuits. In any event, there is a relay A and a relay B in the simplified design. The contact 40 of relay A is in series with the coil 42 of relay B. Similarly, the contact 44 of relay B is in series with the coil 46 of relay A. Hence, if one relay is energized, the other will become energized and thus each relay coil will be connected to 12 volts and remain in such state until some external force changes the state of the latching circuit 32. In the embodiment illustrated, the depression of the "clutch engage" button 34 by the user, or via wireless remote control, causes 12 volts to be applied to the top of the coil 46 of relay A via the contacts of the push button switch 34. This energizes relay A, which closes contacts 40, which causes 12 volts to be applied to relay B coil 42. The magnetic switch contacts 22 are normally closed, as noted above. This causes the coil 42 of relay B to be energized, which closes contacts 44. This creates a current path from the top of relay A coil 46 to 12 volts. Thus, when the push button 34 is released, relay A will be energized, as will relay B, and both relays A and B remain energized until released in the manner described below.

Shown in FIG. 2 is the electrical circuit that drives the solenoid 28. The activation of the solenoid 28 is controlled by the activation of relay B. When relay B is activated, it closes a second contact 48 which applies 12 volts to the solenoid coil 50. This raises the plunger and thus the block 30 from engagement with the notch 26 in the output ring gear 24. As long as the relay latch 32 is in a latched condition, the solenoid 28 will be energized and the clutch will be engaged.

It is noted that the normally-closed magnetic switch contacts 22 are in series with the relay B coil 42. Thus, if the motor 12 of the winch is activated, the disk 14 will turn and the magnet 18 attached thereto will pass by the magnetic switch 20, thus momentarily opening the magnetic switch contacts 22. When opened, the current through the coil 42 relay B will be interrupted and relay B will no longer be energized. When relay B drops out, the contacts 44 will open and thus drop out relay A. This unlatched condition of the latching relay 32 will remain until the "clutch engage" button is again pushed to engage the clutch 10, or the same function is initiated via wireless remote control. As an alternative to the two-relay latching circuit 32, there are magnetic relays with a built-in magnet that keeps the relay latched until electrically unlatched. Some magnetic relays will latch if a current goes through the coil in one direction, and will unlatch if a current goes through the coil in the opposite direction.

In the electrical design of FIGS. 1 and 2, if the winch happens to be stopped where the magnet 18 on the disk 14 is proximate to the magnetic switch 20, the clutch 10 cannot be engaged. This is because the magnetic switch contacts 22 in series with the relay B coil 42 will be open and the latching relay 32 cannot be latched. The LED circuit illustrated in FIG. 3 will show when this condition exists. A second set of contacts 52 of the magnetic switch 20 can be used and connected to a red LED 54 and a green LED 56 in the manner shown. In the normal condition when the magnetic switch 20 is not proximate to the magnet 18 on the disk 14, the switch contacts 52 will be normally closed and allow current through the green LED 56, thus indicating a condition in which the clutch can be engaged. If the motor shaft 16 happens to be at a rotational position where the magnetic switch 20 is proximate the magnet 18 on the disk 14, the switch contacts 52 of the LED circuit will switch and thus the red LED 54 will light, letting the operator know that the clutch cannot be engaged. The operator must then operate the winch momentarily, or pull on the winch cable, until the motor 12 turns the disk 14 and magnet 18 attached thereto moves past the magnetic switch 20. The magnetic switch contacts 52 will switch to the position shown in FIG. 3, whereupon the green LED 56 will be illuminated and indicate the clutch can be engaged.

In connection with the foregoing embodiment, the use of more than a single magnet 18 on the disk 14 results in a faster disengagement of the clutch. That is because it will take a shorter period of time in which one of the magnets will move into proximity to the magnetic switch 20 and cause disengagement of the clutch. It should also be appreciated that the principles and concepts of the invention can be employed without the use of a magnet 18 and a magnetic switch 20. As an alternative, optical means can be utilized to sense movement of the disk 14 or other rotational member of the motor 12. The disk 14 could be constructed with apertures therethrough, and with a light source on one side of the disk 14 and a light-responsive element on the other side of the disk 14. Thus, when the disk 14 is rotated, the rotary motion is sensed when the aperture passes between the light source and the light receiver. The signal from the light receiver can be used to control the relay latch 34 in a manner similar to that described above.

FIG. 4 illustrates another embodiment of the clutch according to the invention. Here, the output ring gear 24 of the gear reduction apparatus of the winch is engageable with a plunger 62 of a bistable solenoid 60. A bistable solenoid 60 is of the type which can remain in either of two stable states without requiring continuous power to be applied to the solenoid 60. Bistable solenoids 60 are well known in the art and can be actuated with a current of one polarity and released with a current of another polarity. In other words, the solenoid 60 can be latched with a positive pulse, for example, and released with a negative pulse. Other than being pulsed, there is no continuous power being applied to the solenoid 60. Bistable solenoids 60 of other types are available and can be employed with the clutch apparatus of the invention. The released state of a bistable solenoid 60 is generally carried out using a spring which forces the solenoid plunger 62 in one direction, such as out of the solenoid housing. A permanent magnet is the other mechanism which maintains the plunger 62 in the other state, for example withdrawn in the solenoid housing. A bistable solenoid 60 is well adapted for use in battery powered winches as no standby battery power is required to maintain the solenoid 60 in either state.

The bistable solenoid 60 shown in FIG. 4 is of the type in which a positive pulse on the positive input of the solenoid 60 is effective to withdraw the plunger 62 and lift it out of engagement with the notch 26 of the ring gear 24. The drum 36 of the winch is thus allowed to freely spool to extract the cable manually from the drum 36 by the operator. A negative pulse on the negative input of the bistable solenoid 60 is effective to overcome the force exerted on the plunger 62 by the internal magnet and allow the spring bias on the plunger 62 to return it to the extended position and into engagement with a notch 26 in the ring gear 24 of the planetary gear reduction assembly 25.

The operation of the winch clutch control mechanism of FIG. 4 is as follows. The cable in and the cable out operations are otherwise the same as described in connection with U.S. Pat. No. 6,995,682, the subject matter of which is incorporated herein by reference. When the person desires to engage the winch clutch and thus remove the coupling between the winch motor 12 and the cable drum 36 so that the cable can be manually played out therefrom, the person depresses the "clutch engage" button 63 on the wireless remote control 64. The specified field in the transmission format will have a code encoded therein and transmitted with the other information to the wireless receiver 66 mounted near the winch. The RF receiver 66 includes a processor 68 that decodes the transmission format and decodes the code in the clutch engage field. The "clutch engage" digital signal is coupled by the processor 68 to a driver 70 for driving the positive input of the bistable solenoid 60. The bistable solenoid 60 is driven so that the plunger 62 is retracted and taken out of engagement with the notch 26 in the ring gear 24. The cable drum 36 can be turned freely so that the cable can be played out.

A similar operation can be carried out if the person near the winch depresses the local switch on the winch labeled "clutch engage." The processor 68 will receive this information via an interface 72 and will then provide a pulse on the "clutch engage" output to the driver 70, like that described above. Thus, the clutch can be controlled either remotely and wirelessly, or by the operator standing next to the winch. Of course, the local "clutch engage" switch could be connected directly to either the driver 70 or the bistable solenoid 60, without going through the processor 68. When it is desired to disengage the clutch so that the winch motor 12 controls the rotation of the cable drum 36 through the planetary gear reduction assembly, the operator can remotely push the "clutch disengage" switch 65 on the wireless remote control 64 which places another code in the field of the transmission format. The code will be received at the winch by the RF receiver 66 and coupled to the processor 68 for decoding. The processor 68 will then place a pulse on the "clutch disengage" output. This pulse will be coupled to a driver 74 for driving the bistable solenoid 60 with a negative pulse so that the plunger 62 is released and falls under spring pressure into engagement with the notch 26 of the ring gear 24. The ring gear 24 will be prevented from rotating and thus the motor 12 will drive the cable drum 36 via the planetary gear reduction assembly.

Alternatively, the clutch can be disengaged locally at the winch by a "clutch disengage" switch on the winch itself. This signal will be received by the processor 68 via the interface 72 which will place a pulse on the "clutch disengage" output to thereby drive the driver 74 and cause the bistable solenoid 60 to be controlled so as to release the plunger 62 into engagement with the ring gear 24 of the planetary gear assembly 25. Again, the local "clutch disengage" switch can be coupled directly to the driver 74 or the bistable solenoid 60 and bypass the processor 68.

It can also be appreciated that either the remote control "clutch disengage" or the local "clutch disengage" switches may not be necessary. Rather, when it is desired to disengage the clutch, the operator need only depress the wireless remote "winch in" button 76, or the local "winch in" switch to start the winch motor 12 in a direction to wind the cable on the drum 36. The processor 68 is programmed to not only receive these signals to controlling the winch motor, but will automatically cause a pulse to be placed on the "clutch disengage" output, and via the driver 74, cause the bistable solenoid 60 to be released so that the plunger 62 moves into engagement with the ring gear notch 26. Rotation of the ring gear 24 is thus prevented.

A similar operation can be carried in response to the depression of the "winch out" switch 78. The "winch out" button 78 on the wireless remote control 64 can be pressed, whereupon the processor 68 carries out a program to automatically engage the clutch so that the cable drum 36 can be spooled without being controlled by the motor 12. Indeed, the motor 12 need not be activated at all. However, in situations where the winch is to be in the "winch out" mode, and where the operation of the motor 12 controls the rate by which the cable is played out of the drum 36, then the operator can override the automatic spooling mode by then pressing the "clutch disengage" button 65, whereupon the clutch is disengaged and the motor 12 is activated to control the rate by which the cable can be played off of the drum 36. In other words, in this latter mode of operation, the default mode of the winch is where the clutch is automatically engaged during "winch out" operations, but can be overcome by pushing the "clutch disengage" button 65. This mode of operation could otherwise be invoked by pushing the "winch out" button 78 of the remote control 64, and then pushing the "clutch engage" button 63. However, when the default is programmed in the processor 68 to be the spooling mode when the "winch out" button 78 is pressed, only a single switch actuation is required, and the motor 12 does not operate.

Another feature can be programmed into the processor 68. The processor 68 can be programmed to allow the clutch to be engaged for a specified period of time, and after such time has elapsed, will automatically cause the "clutch disengage" signal to be output to disengage the winch clutch. This is a fail safe feature that causes the winch to be automatically disengaged in the event the operator forgets to disengage the clutch after the specified period of time. The time can be 5, 10 or 15 minutes or whatever may be desired by the user. During setup of the winch, the operator can program the processor 68 to the desired delay period before the clutch is automatically disengaged.

From the foregoing, disclosed is a clutch mechanism that can be employed in many situations on a variety of equipment types. It should be understood that the clutch of the invention is not limited to winch or hoist equipment, but can be integrated into many other drive systems. The clutch according to various embodiments of the invention can be controlled by wireless means, and requires no electrical energy during engagement of the clutch. The winch decoding and control circuits are controlled by a programmed processor to provide a variety of options and default modes to facilitate operation of the clutch.

While the preferred and other embodiments of the invention have been disclosed with reference to specific winch embodiments, and associated methods thereof, it is to be understood that many changes in detail may be made as a matter of engineering choices without departing from the spirit and scope of the invention, as defined by the appended claims.

What is claimed is:

1. A clutch operable with a planetary gear reduction assembly to provide engagement and disengagement between a motor and a cable drum, said clutch comprising:

a block;

a solenoid having a plunger adapted for moving said block between two positions, said solenoid of the type that is electrically energized to move said block;

said planetary gear reduction assembly including a ring gear, and said block adapted for engaging said ring gear to disengage said clutch and thereby prevent rotation of said ring gear, and said block adapted for being removed from engagement with said ring gear to engage said clutch and allow rotation of said ring gear;

a winch control having a clutch switch which, when activated, drives said solenoid with electrical energy to cause said block to be retracted to a first position out of engagement with said ring gear to thereby engage said clutch;

said winch control adapted to control said solenoid to cause said block to be extended to a second position and into engagement with said ring gear to thereby disengage the clutch; and a sensor responsive to activation of the motor to cause operation of said solenoid to move said block into engagement with said ring gear to thereby automatically disengage the clutch when the motor is activated.

2. The winch clutch of claim 1, wherein said motor is reversible, and further including means for automatically disengaging said clutch when said motor is activated in either direction.

3. The winch clutch of claim 1, further including a processor for controlling operation of the winch, said processor programmed to respond to a "winch in" command to disengage said clutch.

4. The winch clutch of claim 3, wherein said processor is programmed to respond to a "clutch disengage" command to control said solenoid to move said block into engagement with said ring gear.

5. The winch clutch of claim 1, further including a processor for controlling operation of the winch, said processor programmed to respond to a "winch out" command to disengage said clutch.

6. The winch clutch of claim 5, wherein said processor is programmed to respond to a "clutch engage" command to actuate said solenoid to move said block out of engagement with said ring gear.

7. The winch clutch of claim 1, further including a processor for controlling operation of the winch, said processor programmed to respond to a "winch out" command by controlling said solenoid to cause said clutch to become engaged without actuating said motor.

8. The winch clutch of claim 1, further including a processor for controlling operation of the winch, said processor programmed to respond to a command to control said solenoid to engage the clutch, and after a specified period has elapsed, the processor causes the clutch to become disengaged.

9. The winch clutch of claim 1, further including a processor for controlling operation of the winch, said processor programmed to respond to wireless commands to control the winch, and programmed to respond to commands carried by wires to control the winch.

10. The winch clutch of claim 1, further including a processor to control operations of the winch, and a receiver for receiving wireless signals, where a wireless transmission format includes a field for a data command indicating whether the clutch should be engaged or disengaged, and said processor is programmed to respond to said data command to control said solenoid accordingly.

11. The winch clutch of claim 1, wherein said solenoid comprises an electrical bistable solenoid that needs no electrical energy to maintain two stable positions of the plunger.

12. The winch clutch of claim 1, wherein said block comprises an end of said plunger.

13. A method of controlling a winch clutch, comprising the steps of:

using a motor to drive a planetary gear reduction assembly and thereby drive a cable drum;

using a ring gear of the planetary gear reduction assembly as a clutch to allow rotary power of the motor to be uncoupled and coupled to the cable drum, including preventing rotation of the ring gear to disengage the clutch and allow the motor to drive the cable drum through the planetary gear reduction assembly, and allowing rotation of the ring gear to engage the clutch and prevent the motor from driving the cable drum;

using a programmed processor to control the cable drum, where said processor is programmed to respond to:

1) a "cable in" command to disengage the clutch, if engaged, and prevent rotation of the ring gear, and to drive the cable drum in a direction to wind a cable onto the cable drum,
2) a "cable out" command to drive the cable drum in an opposite direction to unwind the cable from the drum,
3) a "clutch engage" command to control the ring gear so as to allow rotation thereof, and
4) a "clutch disengage" command to control the ring gear so as to prevent rotation thereof.

14. The method of claim 13, further including programming the processor with a mode to respond to the "cable in" command by carrying out the "cable in" command in addition to the "clutch disengage" command.

15. The method of claim 13, further including programming said processor with a mode in which the processor responds to the "cable out" command by carrying out said "clutch engage" command, and preventing operation of the motor.

16. The method of claim 13, further including programming said processor to carry out the "clutch engage" command, and after a predetermined period of time thereafter, automatically carrying out the "clutch disengage" command.

17. The method of claim 13, further including providing a wireless receiver for receiving commands from remote locations via a transmission format having one or more fields for carrying clutch operation commands.

18. The method of claim 17, further including providing a switch interface coupled to the programmed processor for receiving commands via wires from respective switches located proximate to the winch clutch.

* * * * *